United States Patent [19]

Gano

[11] Patent Number: 4,728,249

[45] Date of Patent: Mar. 1, 1988

[54] TELESCOPING BOOM ASSEMBLY WITH LONGITUDINALLY DISPLACEABLE BASE BOOM SECTION

[75] Inventor: John W. Gano, New Philadelphia, Ohio

[73] Assignee: The Gradall Company, New Philadelphia, Ohio

[21] Appl. No.: 807,553

[22] Filed: Dec. 11, 1985

[51] Int. Cl.[4] ..... E02F 3/20; B66C 23/00

[52] U.S. Cl. ..... 414/718; 212/267

[58] Field of Search ..... 414/694, 718, 749; 52/118, 632, 645; 212/187, 230, 264, 267, 268; 172/679, 734; 37/103, 117.5, 118 R

[56] References Cited

U.S. PATENT DOCUMENTS

| | | | |
|---|---|---|---|
| 3,298,548 | 1/1967 | Long et al. | 414/694 |
| 3,329,291 | 7/1967 | Przybylski et al. | 414/718 |
| 3,465,904 | 9/1969 | Pensa | 414/718 X |
| 3,493,133 | 11/1967 | Mrozek | 414/694 |
| 3,587,886 | 6/1971 | Gano et al. | 414/718 |
| 3,599,814 | 8/1971 | Brownfield | 414/718 |
| 3,666,125 | 5/1972 | Gano et al. | 414/718 |
| 3,768,665 | 10/1973 | Eiler et al. | 212/197 |
| 3,923,172 | 12/1975 | Jankowiak | 414/694 X |
| 3,977,148 | 8/1976 | Ranini | 212/187 X |
| 4,047,618 | 9/1977 | Kuester | 212/187 X |
| 4,049,238 | 9/1977 | Brown | 212/264 X |
| 4,411,070 | 10/1983 | Boyum et al. | 212/264 X |

FOREIGN PATENT DOCUMENTS

| | | | |
|---|---|---|---|
| 294429 | 9/1965 | Australia | 37/103 |
| 2233450 | 1/1975 | France | 414/718 |
| 871100 | 6/1961 | United Kingdom | 414/128 |
| 2053149 | 2/1981 | United Kingdom | 212/267 |

OTHER PUBLICATIONS

*Hydraulic Excavators Comparative Data,* Dataquest Incorporated, vol. CAO-189.

*Primary Examiner*—Joseph J. Rolla
*Assistant Examiner*—Edward S. Ammeen
*Attorney, Agent, or Firm*—Kirkpatrick & Lockhart

[57] ABSTRACT

Apparatus for providing additional effective length to the telescoping boom of a material handling apparatus is provided. A pivotable boom cradle is supported on an upper structure of the material handling apparatus. The boom cradle pivotally supports the base boom section by means of front and rear cradle arms. Front and rear straps are provided to attach the boom to the cradle arms. In addition, front stop blocks are provided intermediate the length of the base boom section while rear stop blocks are provided adjacent the trailing end thereof. In normal operation, bolts secure the front stop blocks to the front portion of the boom cradle. When it is desired to operate with an additional entended length of the boom, the material handling implement is imbedded in the ground, the bolts securing the front stop blocks to the boom cradle are removed and the bolts securing the front and rear straps to their respective cradle arms are loosened. The boom is then retracted which effectively causes the base section thereof to move forward toward the material handling implement while sliding on the front and rear cradle arms until the rear stop blocks engage the rear cradle arm. The bolts removed from the front stop blocks are secured between the rear stop blocks and the rear cradle arm and the bolts on the front and rear securing straps are tightened thereby readying the material handling apparatus for operation with an additional length of boom.

25 Claims, 11 Drawing Figures

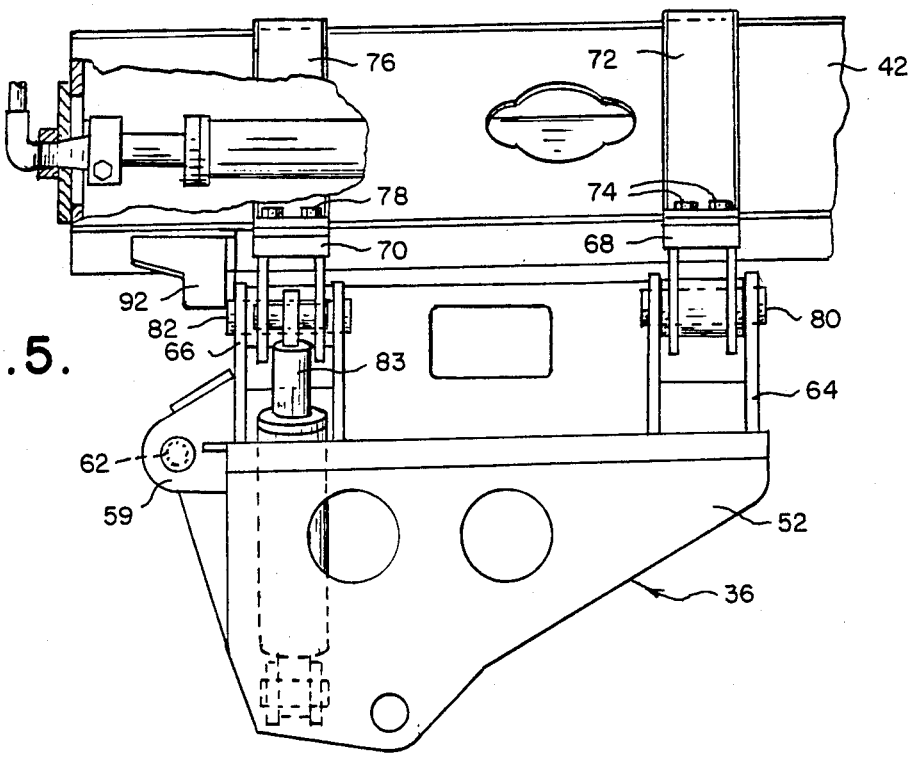
Fig. 5.
Fig. 6.
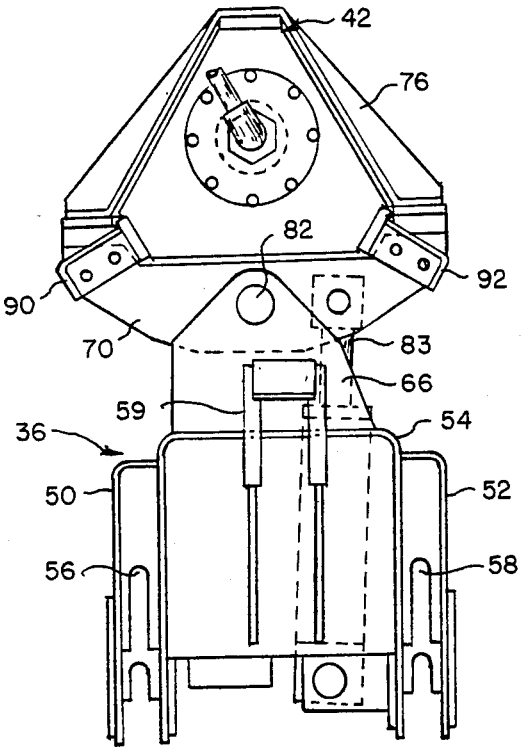
Fig. 7.
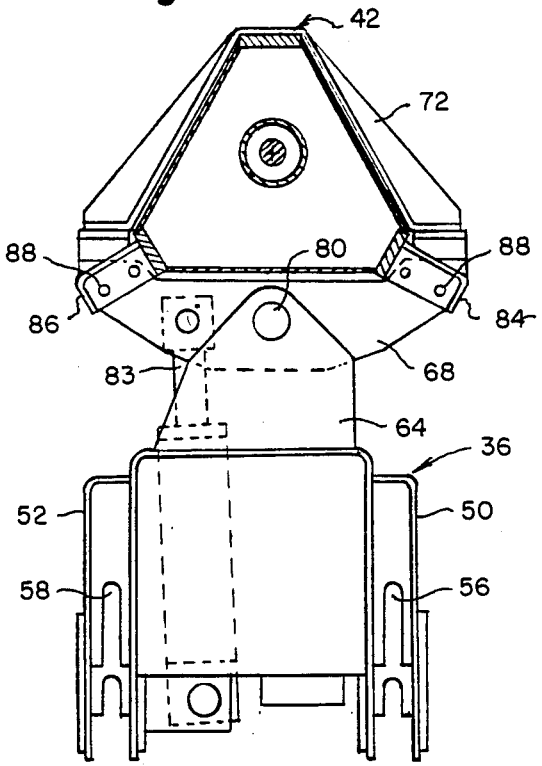

TELESCOPING BOOM ASSEMBLY WITH LONGITUDINALLY DISPLACEABLE BASE BOOM SECTION

BACKGROUND OF THE INVENTION

Reference is made to the following pending U.S. patent applications which were filed on the same date the instant application was filed, are owned by the assignee of the present application, and which relate to the same commercial apparatus on which this instant invention is employed: Ser. No. Ser. No. 807,616, U.S. Pat. No. 4,705,450, Ser. No. 807,573, U.S. Pat. No. 4,700,802, and Ser. No. 807,617, U.S. Pat. No. 4,705,295.

FIELD OF THE INVENTION

The present invention relates to material handling apparatus having a telescoping boom and, in particular, to an apparatus for allowing such a boom to have a longer effective operating length.

DESCRIPTION OF THE PRIOR ART

In various material handling applications it has proven expedient to provide a work implement on the end of a boom means. Frequently, such a boom means is pivotally mounted to a structure which may be supported by a truck chassis. The truck chassis is capable of being driven over the road or highway under control of an operator in the main truck cab. The material handling mechanism is supported on an upper structure which is mounted on a swing bearing through which a center pin extends for relative movement with respect to the truck chassis. The material handling device will preferably include a boom and a work implement. An upper structure operator's cab is provided on the upper structure to move with the material handling mechanism. During operation at a construction site, an operator in the upper structure operator cab can control movement of the truck chassis and also of the material handling mechanism.

In the case of a material handling apparatus such as an excavator, a hydraulically operated, telescoping boom means is preferably vertically pivotally mounted on the upper structure. The boom means is typically capable of being raised or lowered by means of a hydraulic cylinder connected between the boom support and the upper structure. In addition to the extension and raising of the boom, such booms are also capable of being tiltable about their axis. In addition, the work implement, such as a bucket, is preferably operable. For example, the bucket may be displaced between open and closed conditions.

Also, as indicated above, the upper structure is preferably horizontally pivotable upon the lower chassis in order that materials may be handled at distances remote from the vehicle and located on virtually any side thereof. A problem which frequently arises in connection with the manipulation of objects remote from the vehicle is the ability of the extended boom means to be of sufficient length to allow the material handling implement to reach the desired locale. It appears that in many instances it would be preferable to provide a boom of greater extended length. However, it will be readily appreciated that the provision as standard equipment on a material handling apparatus of an inordinately lengthy boom would add significantly to the initial cost and weight of the material handling apparatus. As such, those skilled in the art have determined that the provision of an additional telescoping member or of an exceptionally long boom means is not feasible due to the infrequency with which such additional boom length is required.

One prior art means of providing added length to a boom without requiring the initial construction of the boom to be of exceptional length is to provide a boom extension. Such a boom extension is typically provided as an optional, extra cost feature to the material handling apparatus and usually comprises a length of boom that may be affixed between the usual end of the boom and the material handling implement. However, it must be appreciated that this practice of providing a boom extension is also plagued with certain difficulties. For example, the purchasers of material handling implements typically prefer not to incur the additional added expense of purchasing the optional boom extension. In addition, it is frequently inconvenient for the material handling apparatus to carry the boom extension with it from job site to job site. Hence, an outside means of transporting the boom extension is required. An additional and principal concern of users of material handling apparatus which require employment of a boom extension is the excessive time required for the material handling implement to be removed from the current end of the boom, for the boom extension to be attached to the end of the boom and for the material handling implement to be connected to the end of the boom extension. It will be readily appreciated that the time required for an operator to add the additional length of a boom extension may be seen as excessive and causes unprofitable down-time for the material handling apparatus itself.

The subject invention is directed toward a means for providing an additional length to the boom of a material handling apparatus which overcomes, among others, the above-discussed problems and which provides an effective, efficient, inexpensive and readily utilized means for extending the effective length of such a boom without requiring the use of boom extensions or the provision of an inordinately lengthy standard boom.

SUMMARY OF THE INVENTION

In accordance with the present invention there is provided apparatus for extending the effective length of the boom of a material handling apparatus. A telescoping boom of a material handling apparatus is supported by a vertically tiltable boom cradle which is pivotally attached to an upper structure of a material handling vehicle. A hydraulic cylinder means is provided to motivate the pivoting of the boom cradle with respect to the upper structure of the material handling apparatus.

The boom itself consists of a first boom section which is affixed to the boom cradle and a second boom section which is provided to telescope within the first boom section and is supported thereby by rollers intermediate the first and second boom sections. A movable material handling implement, such as a bucket, is provided on the free end of the second boom section. The boom cradle includes upstanding front and rear brackets which, by means of pivotable support pins, support front and rear cradle arms. While the first boom section is supported by the cradle arms, front and rear retaining straps are provided to pass around the first boom section and are bolted to the front and rear cradle arms, respectively. A hydraulic cylinder is provided between the rear cradle arm and the boom cradle itself which allows the pivoting of the boom about an axis passing through the support pins.

A first pair of stop blocks is affixed to the lower portion of first boom section intermediate the length thereof so as to extend downwardly therefrom. A second set of stop blocks is provided at the trailing end of the first boom section and also extends downwardly therefrom. In normal operation, the first boom section is affixed to the boom cradle by means of dual straps which pass around the first boom section and which are rigidly attached to the boom cradle. In addition, when the boom is in its normal operating position, bolts are caused to pass between the first stop blocks and the front cradle arm to further secure the first boom section thereto.

When, however, it is desired to add additional effective length to the boom, the bucket affixed to the end of the boom is set into the ground and the engine is stopped. The bolts intermediate the first stop blocks and the front cradle arm are then removed and the bolts securing the retaining straps to the boom cradle are loosened. The engine is started and the boom retracted which effectively causes the boom to be displaced relative to the boom cradle until the second stop blocks engage the boom cradle. At this point, the bolts are inserted between the second stop blocks and the rear cradle arm and the bolts of the securing straps are tightened thereby resecuring the boom to the boom cradle.

In the event that it is desired to add additional effective length to the boom, but not to the full extent of the distance between the first and second stop blocks less the length of the boom cradle due to the lifting limitations thereby imposed on the boom, it is also possible, according to the present invention, to add a portion of such length. In that event, spacer bars having a face plate on each end thereof are inserted between the appropriate stop blocks and the corresponding cradle arm. Cap screws are then affixed between one face plate of the spacer bar and the appropriate stop block and between the other face plate of the spacer bar and the corresponding cradle arm. By the use of such spacer bars, an additional effective length less than the maximum length available may be employed.

Accordingly, the present invention provides solutions to the aforementioned problems connected with material handling vehicles. As this invention provides an effective means of adding additional working length to the boom of a material handling apparatus the operating length thereof is effectively increased without requiring the provision of boom extensions or of the additional weight and cost involved with an inordinately long standard boom.

These and other details, objects and advantages of the invention will become apparent as the following description of the present preferred embodiment thereof proceeds.

BRIEF DESCRIPTION OF THE DRAWINGS

FIG. 5 is a more detailed right-side elevation view of the boom means;

FIG. 6 is a detailed rear elevation view of the boom means provided herein;

FIG. 7 is a detailed front elevation view of the boom means of the present invention;

DETAILED DESCRIPTION OF THE PREFERRED EMBODIMENTS

Figure 1:
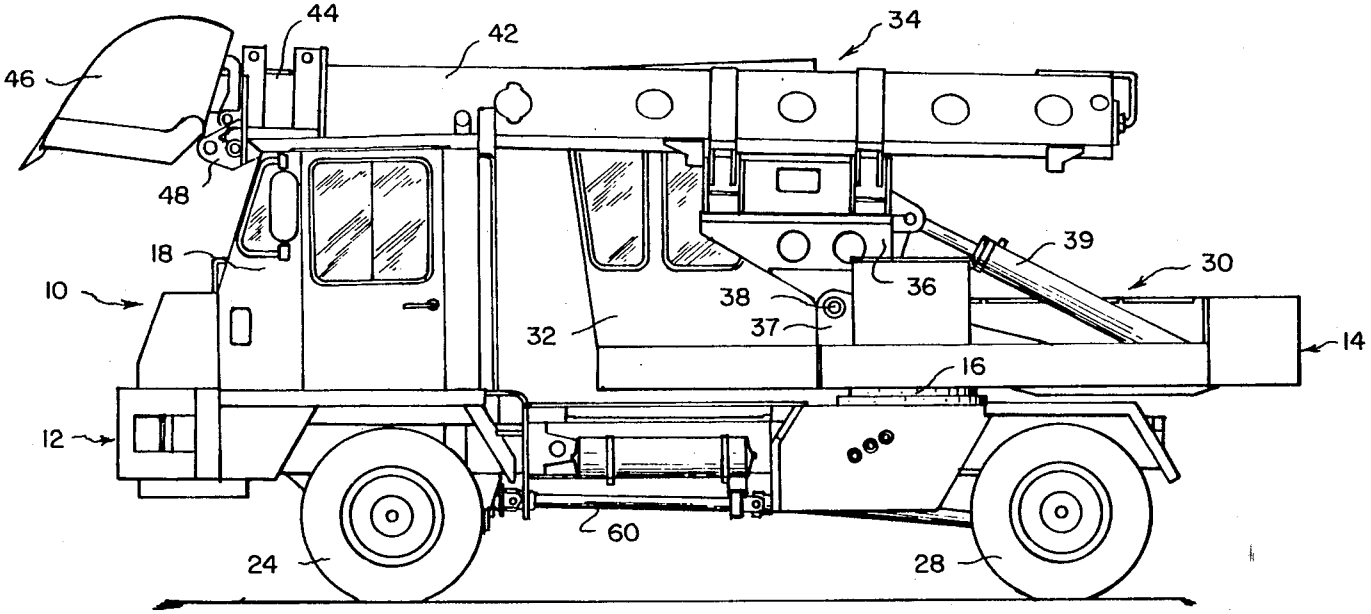
FIG. 1 is a left side elevation view of a truck mounted extensible boom hydraulic excavator.
Figure 2:
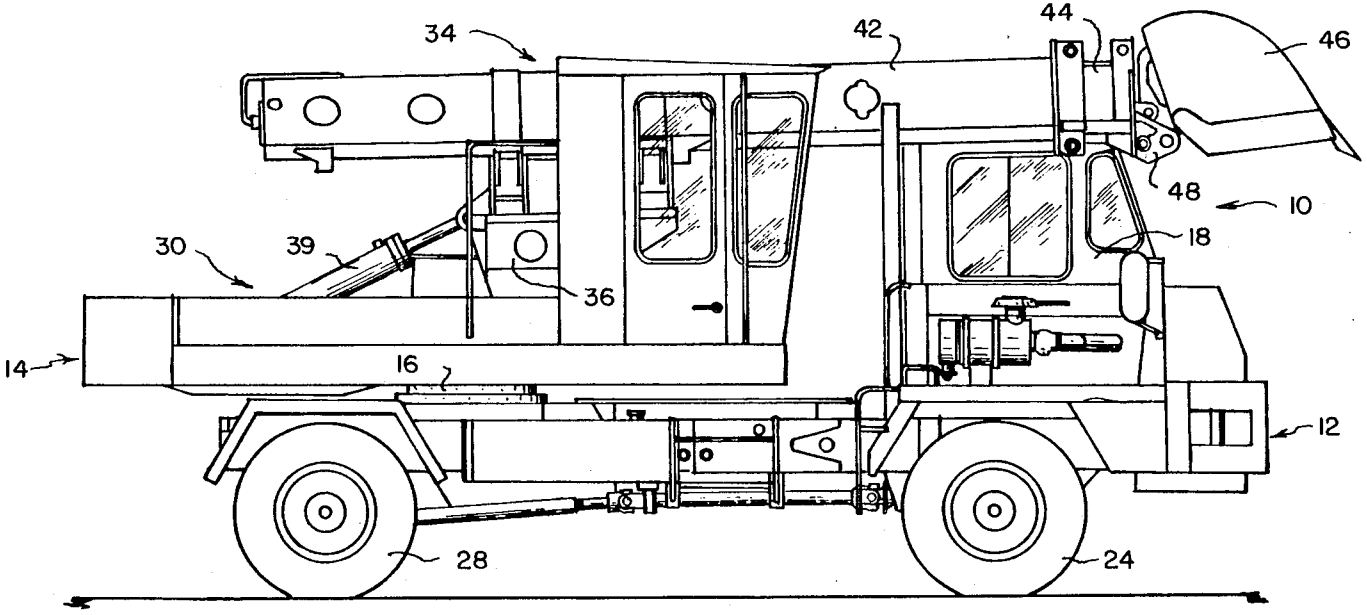
FIG. 2 is a right side view of the excavator shown in FIG. 1.
Figure 3:
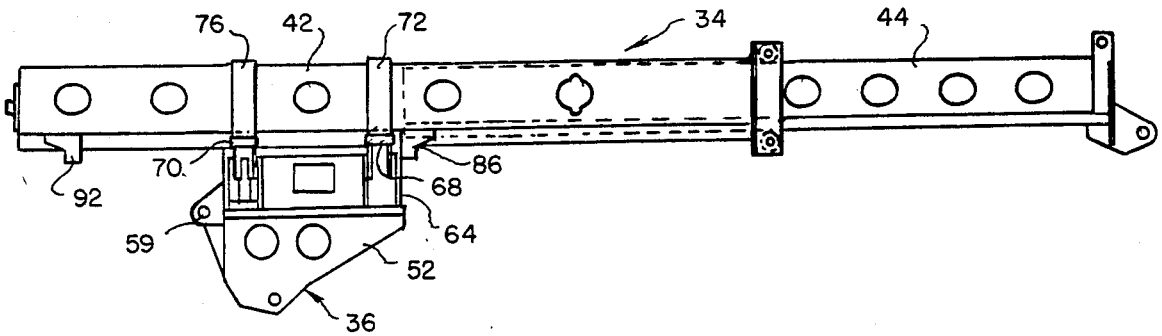
FIG. 3 is a right side elevation view of the extensible boom means of a material handling apparatus.
Figure 4:
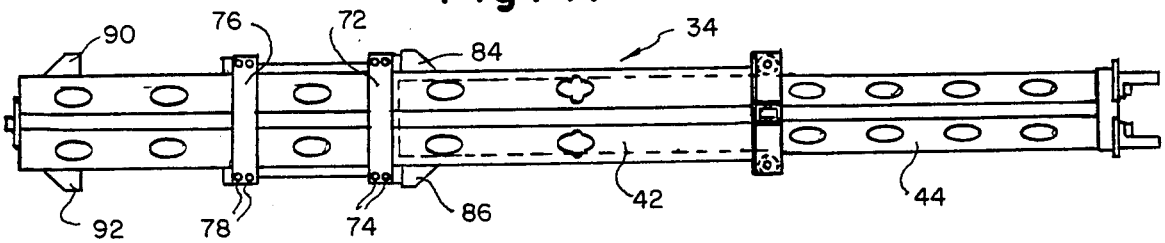
FIG. 4 is a plan view of the boom means shown in FIG. 3.
Figure 8:
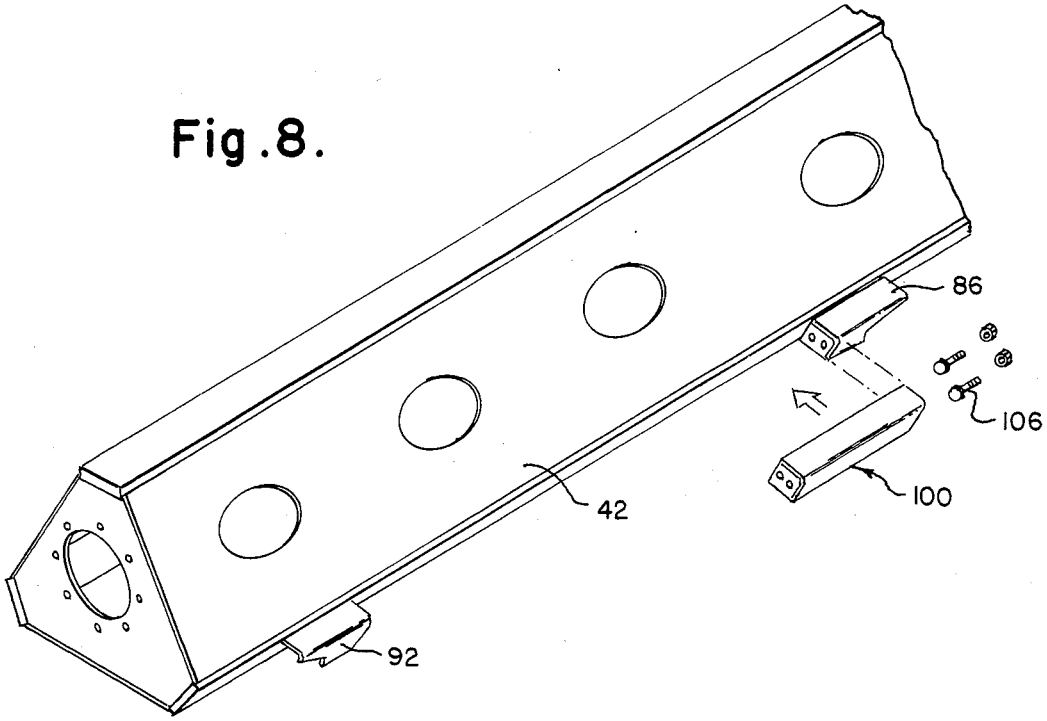
FIG. 8 is a perspective view of the boom adjustment spacing means herein provided; and, FIGS. *9a*, *9b* and *9c* are left elevation, front elevation and plan views of the spacing means disclosed herein.
Figure 9A:
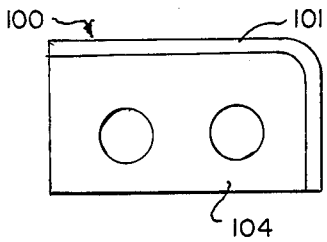
Figure 9B:
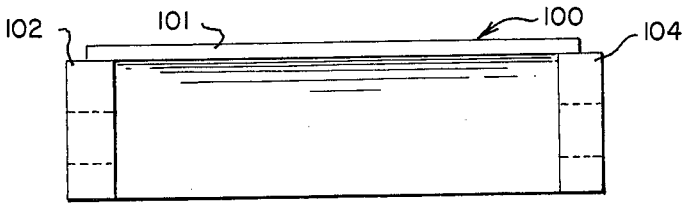
Figure 9C:
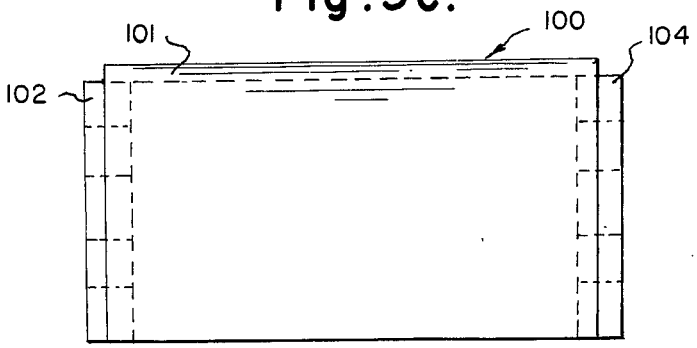

Referring now to the drawings wherein the showings are for purposes of illustrating the present preferred embodiment of the invention only and not for purposes of limiting same, the figures show a mobile material handling apparatus 10 which, for purposes of the present DETAILED DESCRIPTION OF THE PREFERRED EMBODIMENTS, will be described as an extensible boom hydraulic excavating apparatus, also called an excavator.

More particularly and with reference to FIG. 1 there is shown an excavator 10 which includes a lower truck chassis 12 and an upper structure 14 rotatably supported thereon by means of a swing bearing 16 through which passes a center pin. Lower chassis 12 is provided with a truck cab 18 mounted beside an engine (not shown). A front axle (not depicted) supports the end of lower chassis 12 nearest truck cab 18 on front wheels 24 while a rear axle (not shown) supports the rear of lower chassis 12 on rear wheels 28.

The upper structure 14 includes a platform, generally indicated as 30, on one end of which is mounted a remote operator cab 32. In addition, an extensible boom, generally 34, is mounted to a boom support cradle 36 which is pivotally attached to an upstanding support member 37 of upper platform 30 by means of pins 38. As such, boom cradle 36 allows boom 34 to be vertically pivotable with respect to upper platform 30. Such vertical pivoting of boom 34 is accomplished by means of hydraulic hoist cylinder 39 attached between boom cradle 36 and the end of upper platform 30 remote from operator cab 32.

Boom 34 includes a base or first section 42 mounted to boom cradle 36 and a second extensible boom section 44 which is provided to be supportable by and hydraulically retractable within first section 42. However, it is to be understood that boom 34 may consist of any number of sections, one of which is attached to boom cradle 36. A material handling implement 46, such as a bucket, is preferably movably attached to the free end of second boom section 44 by means of a pivotable support 48 which will preferably include a means, such as a hydraulic cylinder for pivoting bucket 46 relative to boom 34.

With respect to the general operation of excavator 10, truck cab 18 is occupied by an operator during over the road or distant movement of the excavator 10 to a selected job site. Operator cab 32 is occupied by the operator for control of excavator 10 around a given job site and when it is desired to manipulate a work implement such as a bucket 46 or to rotate upper structure 14 in a manner known in the art. The movement of lower chassis 12 can be provided by either a two wheel drive system in which only rear wheels 28 are preferably driven or a four wheel drive system in which all wheels 24 and 28 are driven. General operating characteristics and functional capabilities of a material handling apparatus 10 are similar to those disclosed in U.S. Pat. Nos. 3,587,886; 3,599,814 and 3,666,125.

Boom cradle 36 includes left and right side panels 50 and 52, respectively, which are secured to an inner box member 54. In addition, left and right brackets 56 and 58, respectively, are provided intermediate the spaces between side panels 50 and 52 and box member 54. As such, coaxial apertures are provided through left side panel 50, left bracket 56, both sides of inner box member 54, right bracket 58 and right side panel 52 to receive the pivot pin 38 which functions to movably support boom cradle 36, and hence, boom 34 by means of vertically extending support bracket 37 extending upwardly from upper structure 14. Further, apertures are provided through the rearwardly extending portions of hoist cylinder mounting bracket 59 to receive a pivot pin 62 which attaches boom cradle 36 to hydraulic hoist cylinder 39 effective to accomplish the hoisting of boom cradle 36 relative to upper structure 14.

Front and rear boom support brackets 64 and 66, respectively, are provided to extend upwardly from the upper surface of inner box member 54. In order to pivotally support boom 34, there are provided a laterally extending front cradle arm 68 and a rear cradle arm 70 on the upper surfaces of each of which rests first boom section 42. First boom section 42 is secured to boom cradle 36, in part, by means of a front clamping means such as a strap 72 which passes around the upper portions of boom section 42 and which has extended ears which are secured to front cradle arm 68 by means of cap screws 74. Similarly, a rear clamping means such as a strap 76 which also passes around boom section 42 and has extended ears, is thereby secured to rear cradle arm 70 by means of cap screws 78. A front tilt pin 80 is provided to pass intermediate apertures in front cradle arm 68 and front boom support bracket 64 and rear tilt pin 82 is provided between apertures in rear cradle arm 70 and rear boom support bracket 66. As such, an axis of pivot for boom 34 parallel to its axis but spaced therefrom is provided along front and rear tilt pins 80 and 82, respectively. A tilt cylinder 83 is preferably provided operatively between inner box member 54 and rear cradle arm 70 so as to provide the tiltability of boom 34 about the axis defined by front tilt pin 80 and rear tilt pin 82.

Also provided on the lower surface of first boom section 42 approximately intermediate its length are left front stop block 84 and right front stop block 86. Cap screws 88 are provided to pass between left front stop block 84 and the left side of front cradle arm 68 and between right front stop block 86 and the right side of front cradle arm 68 so as to further secure first boom section 42 to cradle 36. The position in which the front stop blocks 84 and 86 engage the front cradle arm 68 will be referred to as the standard operating position. In addition, left rear stop block 90 and right rear stop block 92 are secured to the lower portion of first boom section 42 adjacent the trailing end thereof. As such, if the boom 34 were displaced forwardly with respect to cradle 36, left rear stop block 90 and right rear stop block 92 may be secured to the rear portions of rear cradle arm 70 by means of cap screws 88, thereby effectively increasing the operating length of boom 34. The "available additional length" as used herein will be that length equal to the distance between the front stop blocks 84 and 86 and the rear stop blocks 90 and 92 minus the distance between the outermost faces of front cradle arm 68 and rear cradle arm 70. Such distance may consist of a substantial portion of the length of base boom section 42 and will preferably be of at least three feet.

In operation, therefore, to effectively increase the length of boom 34, the operator of excavator 10 positions the upper structure 14 with the boom 34 extending over one side or over the end of lower chassis 12. Second boom section 44 is extended and the edge of bucket 46 is placed level into the ground. With the engine stopped, cap screws 88 are removed from between left front stop block 84 and front cradle arm 68 and from between right front stop block 86 and front cradle arm 68. In addition, cap screws 74 which secure front strap 72 to front cradle arm 68 and cap screws 78 which secure rear strap 76 to rear cradle arm 70 are loosened but preferably not removed. The operator then restarts the engine of the vehicle 10 and operates the appropriate control to cause the second boom section 44 to be retracted relative to the first boom section 42 which, due to the bucket 46 being imbedded in the ground, causes the first boom section 42 to slide forward relative to second boom section 44 until rear stop blocks 90 and 92 contact rear cradle arm 70. The engine is then stopped and the cap screws 88 previously removed from front stop blocks 84 and 86 are securely installed between left rear stop block 90 and rear cradle arm 70 and between right rear stop block 92 and the other end of rear cradle arm 70. The cap screws 74 which attach front strap 72 to front cradle arm 68 and cap screws 78 which attach rear strap 76 to rear cradle arm 70 are then tightened to the required torque. Due to this operation, the boom is positioned in an effectively extended position and is able to continue operation with an extended reach but a decreased capacity. It will be clear to those in the art that the above-described procedure may be reversed to return the boom 34 to its standard operating position.

It will be appreciated that as the effective length added to boom 34 is increased the capacity thereof decreases. As such, it may, in order to maintain a specified loading capacity of the boom 34, be desired to only increase its effective length an amount less than the full range available which length will be referred to as the modified additional length. In that instance, spacer bars 100 may be employed. Spacer bars 100 preferably each comprise an elongated metallic bar 101, which may assume an angle-like cross section, having a first face plate 102 affixed to one end thereof and a second face plate 104 affixed to the other end thereof. As such, face plates 102 and 104 extend perpendicularly of the axes of spacer bars 100. The spacer bars 100 are of equal length which length is less than the available additional length. By means of example only, if the available additional length is three feet and the length of spacer bars 100, including face plates 102 and 104, is one foot the modified additional length may be one or two feet. In order to provide a modified additional length of one foot, the bucket 46 is secured to the ground, the engine 20 is stopped and the cap screws 88 are removed from between the front stop blocks 84 and 86 and the front cradle arm 68 and the cap screws 74 and 78 loosened. The engine 20 is started and the second boom section 44 is retracted relative to base boom section 42 an amount greater than the length of spacer bars 100. The engine 20 is stopped and the spacer bars 100 are installed by securing first face plates 102 by means of cap screws 88 to front stop blocks 84 and 86, respectively. The engine is then restarted and second boom section 44 is extended until front cradle arm 68 meets face plates 104 of spacer bars 100. Cap screws 74 and 78 are retightened and additional cap screws 106 are then secured between front cradle arm 68 and face plates 104 thereby providing a modified additional length of one foot.

In the event it is desired to provide a modified additional length of two feet from the standard operating position using spacer bars 100 which are one foot in length, the engine 20 is stopped and the cap screws 74 and 78 loosened. The cap screws 88 are removed from the position between front stop blocks 84 and 86 and the front cradle arm 68. The spacer bars 100 are then installed by securing second face plates 104 to rear stop blocks 90 and 92 by means of cap screws 88. The engine 20 is restarted and the second boom section 44 is retracted relative to base boom section 42 until rear cradle arm 70 meets the second face plates 104 of spacer bars 100. The engine 20 is then stopped and cap screws 106 installed intermediate rear cradle arm 70 and first face plates 102 of spacer bars 100. The cap screws 74 and 78 on the front and rear straps 72 and 76, respectively, are tightened and the boom 34 is prepared for operation with a modified additional length of two feet.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A boom assembly for a material handling apparatus comprising:

a. a telescoping boom comprising a base boom section and at least one extensible boom section telescopingly received within said base boom section and having a free end adapted to receive a work implement;

b. a boom support element supported by said material handling apparatus, said boom support element comprising:

(i) a boom cradle having first and second transverse cradle arms, said cradle arms extending perpendicularly of the axis of said telescoping boom; and (ii) means for releasably attaching said base boom section to said cradle arms;

c. means for longitudinally displacing said base boom section relative to said boom cradle when said base boom section is released from engagement therewith;

d. at least one first stop means secured to said base boom section intermediate the length thereof, said first stop means being releasably attachable to said first cradle arm;

e. at least one second stop means secured to said base boom section adjacent the end thereof remote from the free end of said extensible boom section, said second stop means being releasably attachable to said second cradle arm; and f. said means for displacing said base boom section comprises means for reversably displacing said base boom section between a first position in which said first stop means is disposed adjacent said first cradle arm and a second position in which said second stop means is disposed adjacent said second cradle arm.

2. Apparatus of claim 1 further comprising spacing means selectively installable between said first stop means and said first cradle arm or between said second stop means and said second cradle arm.

3. Apparatus of claim 1 further comprising:

a. a first strap member releasably attached to said first cradle arm, said first strap member extending from one side of said first cradle arm around said base boom section to the other side of said first cradle arm; and, b. a second strap member releasably attached to said second cradle arm, said second strap member extending from one side of said second cradle arm around said base boom section to the other side of said second cradle arm.

4. Apparatus of claim 3 in which said first stop means comprises a pair of first stop blocks attached to a lower surface of said base boom section and extending radially outwardly therefrom, each of said first stop blocks having a flat face perpendicular to the axis of said base boom section and in facing relation to said first cradle arm.

5. Apparatus of claim 4 in which said second stop means compries a pair of second stop blocks attached to a lower surface of said base boom section and extending radially outwardly therefrom, each of said second stop blocks having a flat face perpendicular to the axis of said base boom section and in facing relation to said second cradle arm.

6. Appnaratus of claim 5 further comprising two spacing bars each of said spacing bars being selectively installable between one of said first stop blocks and said first cradle arm or between one of said second stop blocks and said second cradle arm.

7. Apparatus of claim 6 in which said spacer bars each comprise:

a. an elongated bar member;

b. a first face plate affixed to one end of said bar member, said first face plate being perpendicular to the axis of said bar member; and, c. a second face plate affixed to the other end of said bar member, said second face plate being perpendicular to the axis of said bar member.

8. Apparatus of claim 1 further comprising:

a. a horizontal axle means mounted on said material handling apparatus for pivotally supporting said boom cradle for vertical pivotal movement about said horizontal axle means; and b. means for vertically pivoting said boom cradle relative to said material handling apparatus about said horizontal axle means.

9. Apparatus of claim 8 further comprising:

a. an upstanding support means affixed to said material handling apparatus, said upstanding support means being provided with a horizontal aperture perpendicular to the axis of said boom;

b. a downward extending portion of said boom cradle, said downward extending portion including a horizontal aperture perpendicular to the axis of said boom; and c. said horizontal axle means comprises a supporting pin adapted to pass through the apertures on said upstanding support means and said downward extending portion of said boom cradle so as to pivotally support said boom cradle on said upstanding support means.

10. Apparatus of claim 9 in which said means for pivoting said boom cradle relative to said material handling apparatus comprises a hydraulic cylinder, the cylinder portion of which is pivotally attached to said material handling apparatus and the piston rod of which is pivotally attached to said boom cradle.

11. Apparatus of claim 10 further comprising:

a. means for pivotally supporting said first and second cradle arms such that said telecsoping boom is pivotable about a tilt axis parallel to the axis of said telescoping boom; and, b. means for pivoting said telescoping boom about said tilt axis.

12. Apparatus of claim 11 in which said means for pivotally supporting said first and second cradle arms comprises:

a. front and rear cradle arm support brackets extending from said boom cradle toward said cradle arms, each of said cradle arm support brackets having an aperture therethrough such that said apertures are in axial alignment along an axis parallel to the axis of said telescoping boom;

b. an aperture in the center of each of said first and second cradle arms, said apertures being in axial alignment along an axis parallel to the axis of said telescoping boom; and, c. two supporting pins, one of which is provided to supportingly pass through the apertures in said front cradle arm support bracket and in said first cradle arm and the other of which is provided to supportingly pass through the apertures in said rear cradle arm support bracket and in said second cradle arm.

13. Apparatus of claim 12 in which said means for pivoting said telescoping boom about said tilt axis comprises a hydraulic cylinder, the cylinder of which is pivotally attached to said boom cradle and the piston rod of which is pivotally attached to said second cradle arm.

14. Apparatus of claim 13 further comprising spacing means selectively installable between said first stop means and said first cradle arm or between said second stop means and said second cradle arm.

15. Apparatus of claim 13 further comprising:

a. a first strap member releasably attached to said first cradle arm, said first strap member extending from one side of said first cradle arm around said base boom section to the other side of said first cradle arm; and, b. a second strap member releasably attached to said second cradle arm, said second strap member extending from one side of said second cradle arm around said base boom section to the other side of said second cradle arm.

16. Apparatus of claim 15 in which said first stop means comprises a pair of first stop blocks attached to a lower surface of said base boom section and extending radially outwardly therefrom, each of said first stop blocks having a flat face perpendicular to the axis of said base boom section and in facing relation to said first cradle arm and said second stop means comprises a pair of second stop blocks attached to a lower surface of said base boom section and extending radially outwardly therefrom, each of said second stop blocks having a flat face perpendicular to the axis of said base boom section and in facing relation to said second cradle arm.

17. Apparatus of claim 16 further comprising two spacing bars each of said spacing bars being selectively installable between one of said first stop blocks and said first cradle arm or between one of said second stop blocks and said second cradle arm.

18. Apparatus of claim 17 in which said spacer bars each comprise:

a. an elongated bar member;

b. a first face plate affixed to one end of said bar member, said first face plate being perpendicular to the axis of said bar member; and, c. a second face plate affixed to the other end of said bar member, said second face plate being perpendicular to the axis of said bar member.

19. Apparatus of claim 18 further comprising a material handling implement movably mounted on said free end of said extensible boom section.

20. Apparatus of claim 19 in which said material handling implement comprises a bucket and a means for pivoting said bucket about a horizontal pivot axis.

21. Method of operating a telescoping boom of a material handling apparatus, said boom having a base boom section adapted to telescopingly receive an extensible boom section having a free end, said base boom section being pivotally attached to said material handling apparatus by means of a boom cradle having first and second laterally extending cradle arms, releasable means for securing said base boom section to said cradle arms, first stop means disposed intermediate the length of said base boom section and releasably attachable to said first cradle arm, and second stop means disposed on the end of said base boom section remote from the free end of said extensible boom section, said second stop means being selectively atachable to said second cradle arm, comprising:

a. extending said extensible boom section relative to said base boom section;

b. restraining the free end of said extensible boom section;

c. releasing said means for securing said base boom section to said first and second cradle arms;

d. releasing said first stop means from said first cradle arm;

e. retracting said extensible boom section relative to said base boom section until said second stop means contacts said second cradle arm;

f. securing said second stop means to said second cradle arm; and g. securing said means for securing said base boom section to said cradle arms.

22. Method of operating a boom of a material handling apparatus, said boom having a base boom section adapted to telescopingly receive an extensible boom section on the end of which is mounted a work implement, said base boom section being pivotally attached to said material handling apparatus by means of a boom cradle having first and second laterally extending cradle arms, releasable means for securing said base boom section to said cradle arms, first stop means disposed intermediate the length of said base boom section and releasably attached to said first cradle arm, and second stop means disposed on the end of said base boom section remote from the end of said extensible boom section, said second stop means being selectively attachable to said second cradle arm, comprising:

a. extending said extensible boom section relative to said base boom section;

b. restraining the end of said extensible boom section by securing said work implement to the ground;

c. releasing said means for securing said base boom section to said first and second cradle arms;

d. releasing said first stop means from said first cradle arm;

e. retracting said extensible boom section relative to said base boom section until said second stop means contacts said second cradle arm;

f. securing said second stop means to said second cradle arm; and g. securing said means for securing said base boom section to said cradle arms.

23. An extendible boom material handling vehicle comprising:

a. a driven lower chassis;

b. an upper structure rotatably supported from said driven lower chassis;

c. a telescoping boom comprising a base boom section and at least one extensible boom section telescopingly received within said base boom section and having a free end adapted to receive a work implement;

d. a boom support element supported by said upper structure, said boom support element comprising:

(i) a boom cradle having first and second transverse cradle arms, said cradle arms extending perpendicularly of the axis of said telescoping boom; and (ii) means for releasably attaching said base boom section to said cradle arms;

e. means for longitudinally displacing said base boom section relative to said boom cradle when said base boom section is released from engagement therewith;

f. at least one first stop means secured to said base boom section intermediate the length thereof, said first stop means being releasably attachable to said first cradle arm;

g. at least one second stop means secured to said base boom section adjacent the end thereof remote from the free end of said extensible boom section, said second stop means being releasably attachable to said second cradle arm; and h. said means for displacing said base boom section comprises means for reversably displacing said base boom section between a first position in which said first stop means is disposed adjacent said first cradle arm and a second position in which said second stop means is disposed adjacent said second cradle arm.

24. An apparatus as claimed in claim 23 comprising:

a. means on said boom support element for supporting said boom cradle for pivotal movement around an axis parallel to the longitudinal axis of said base boom section but located outside of said base boom section; and, b. a single hydraulic cylinder operatively connected between said boom support element and said boom cradle which tilts said base boom section in one direction when extended and in the other direction when retracted.

25. An apparatus as claimed in claim 24 in which said means for releasably attaching comprises:

a. a first strap member releasably attached to said first cradle arm, said first strap member extending from one side of said first cradle arm around said base boom section to the other side of said first cradle arm; and, b. a second strap member, releasably attached to said second cradle arm, said second strap member extending from one side of said second cradle arm around said base boom section to the other side of said second cradle arm.

* * * * *

UNITED STATES PATENT AND TRADEMARK OFFICE

CERTIFICATE OF CORRECTION

PATENT NO. : 4,728,249

DATED : March 1, 1988

INVENTOR(S) : John W. Gano

It is certified that error appears in the above-identified patent and that said Letters Patent is hereby corrected as shown below:

Col. 1, line 12, after "employed:", delete "Ser. No.".

Col. 8, line 24, delete "compries" and substitute therefor --comprises--.

Col. 8, line 30, delete "Appnaratus" and substitute therefor --Apparatus--.

Col. 9, line 7, delete "telecsoping" and substitute therefor --telescoping--.

Signed and Sealed this

Eighteenth Day of October, 1988

*Attest:*

*Attesting Officer*

DONALD J. QUIGG

*Commissioner of Patents and Trademarks*